US007048896B2

(12) United States Patent
Nagel et al.

(10) Patent No.: US 7,048,896 B2
(45) **Date of Patent: *May 23, 2006**

(54) CATALYST CARRIER BODY HAVING A SLEEVE WITH MICROSTRUCTURES ALLOWING EXPANSIONS

(75) Inventors: Thomas Nagel, Engelskirchen (DE); Wolfgang Maus, Bergisch Gladbach (DE); Hans-Günter Faust, Köln (DE); Ludwig Wieres, Overath (DE)

(73) Assignee: Emitec Gesellschaft Fuer Emissionstechnologie mbH, Lohmar (DE)

( * ) Notice: Subject to any disclaimer, the term of this patent is extended or adjusted under 35 U.S.C. 154(b) by 512 days.

This patent is subject to a terminal disclaimer.

(21) Appl. No.: 10/196,833

(22) Filed: Jul. 17, 2002

(65) Prior Publication Data

US 2003/0021740 A1 Jan. 30, 2003

Related U.S. Application Data

(63) Continuation of application No. PCT/EP01/00315, filed on Jan. 12, 2001.

(30) Foreign Application Priority Data

Jan. 17, 2000 (DE) ..... 100 01 639
Apr. 11, 2000 (DE) ..... 100 17 839

(51) Int. Cl.
*B01D 53/94* (2006.01)
*F01N 3/28* (2006.01)

(52) U.S. Cl. ..... 422/180; 422/177

(58) Field of Classification Search ..... 422/177, 422/180; 428/593, 594

See application file for complete search history.

(56) References Cited

U.S. PATENT DOCUMENTS 5,110,561 A * 5/1992 Hitachi et al. ..... 422/180
5,190,732 A * 3/1993 Maus et al. ..... 422/179
5,599,509 A * 2/1997 Toyao et al. ..... 422/180
5,795,658 A * 8/1998 Bode et al. ..... 428/593
6,497,039 B1 * 12/2002 Wieres et al. ..... 29/890

FOREIGN PATENT DOCUMENTS

DE 35 43 011 A1 6/1987
WO WO 99/37896 7/1999

* cited by examiner

*Primary Examiner*—Hien Tran
(74) *Attorney, Agent, or Firm*—Laurence A. Greenberg; Werner H. Stemer; Ralph E. Locher

(57) ABSTRACT

A catalyst carrier body includes a honeycomb body with at least partly structured sheet metal layers having exhaust gas channels. An inner surface of a jacket tube at least partially encloses, and is connected in at least one axial subregion to, the honeycomb body. A sleeve has a length axially less than the honeycomb body and an outer surface against part of the inner surface of the jacket tube. The sleeve is on an outer region of the honeycomb body near an end surface and has an inner surface connected or brazed to radially outward end regions of the sheet metal layers at the end surface for preventing flapping. The sleeve has at least one microstructure for reducing a contact area between sleeve and jacket tube. Such a catalyst carrier body is mechanically and thermally resistant even to high alternating loads and suitable in particular for placement near the engine.

15 Claims, 3 Drawing Sheets

CATALYST CARRIER BODY HAVING A SLEEVE WITH MICROSTRUCTURES ALLOWING EXPANSIONS

CROSS REFERENCE TO RELATED APPLICATION

This application is a continuation of copending International Application No. PCT/EP01/00315, filed Jan. 12, 2001, which designated the United States and was not published in English.

BACKGROUND OF THE INVENTION

1. Field of the Invention

The present invention relates to a carrier body for a catalytic converter, including a honeycomb body, a jacket tube and a sleeve disposed between the honeycomb body and the jacket tube. The invention also relates to a method of producing the carrier body. Such catalytic converters are preferably used in exhaust systems of internal combustion engines, in particular of motor vehicles.

A method of producing a sheathed honeycomb body is described in International Publication No. WO 99/37896. The sheathed honeycomb body has layers of sheet metal, at least some of which are structured, and is produced by laminating and/or winding, so that the honeycomb body has channels through which a fluid can flow. That honeycomb body is surrounded by a jacket tube. The honeycomb body and the jacket tube have a different thermal expansion behavior due to their different material properties and due to different temperatures during operation. It is therefore endeavored to avoid a rigid connection between the honeycomb body and the jacket tube at least at one end region of the honeycomb body. For that reason, the sheathed honeycomb body is formed with a sleeve which is intended to ensure that direct brazed connections between the honeycomb body and the jacket tube are avoided in the at least one end region of the honeycomb body, in spite of production tolerances of the jacket tube and the honeycomb body. During the production of such honeycomb bodies, some points of contact between the honeycomb body and the sleeve are connected to one another, more or less arbitrarily, but many of such points of contact remain unconnected. Although thermal stresses between the jacket tube and the honeycomb body are avoided in that way, no defined joining of the honeycomb body to the sleeve is achieved.

However, a sheathed or encased honeycomb body of that type, which is used as a catalyst carrier body in an exhaust system, is subjected not only to thermal loading but also to dynamic loading. That means that the displaceably disposed end region of the honeycomb body can be induced to oscillate. Undefined fastened points of contact may become detached and unfastened sheet metal layer ends may flap freely, which may lead to the detachment of the catalytically effective coating. Furthermore, there is a risk of those freely flapping subregions being detached from the honeycomb body, blocking neighboring channels or causing damage in neighboring components of the exhaust system.

SUMMARY OF THE INVENTION

It is accordingly an object of the invention to provide a catalyst carrier body having a sleeve with microstructures allowing expansions or elongations, which overcomes the hereinafore-mentioned disadvantages of the heretofore-known devices of this general type and in which the catalyst carrier body both avoids thermal stresses between a jacket tube and a honeycomb body, even under high alternating thermal loads, and avoids flapping of free sheet metal ends or wave crests under dynamic loading, for example due to a pulsating exhaust gas flow.

With the foregoing and other objects in view there is provided, in accordance with the invention, a catalyst carrier body, comprising a honeycomb body having layers of sheet metal, at least some of which are structured layers of sheet metal, so that the honeycomb body has channels through which an exhaust gas can flow. The honeycomb body is at least partially enclosed by a jacket tube connected to the honeycomb body by technical joining only in at least one axial subregion. A sleeve has an axial length less than the axial extent of the honeycomb body and comes to bear essentially against part of an inner wall surface of the jacket tube at a contact area or surface. The sleeve is disposed on an outer circumferential surface of the honeycomb body near an end surface. An inner circumferential surface of the sleeve is connected by technical joining over a circumference to end regions of the layers of sheet metal of the honeycomb body lying radially outwardly at the end surface, in such a way that flapping of these end regions is prevented. The sleeve has at least one microstructure for reducing the contact area or surface between the sleeve and the jacket tube. The radially outer end regions of the layers of sheet metal cannot undergo separate oscillations due to their connection to the sleeve. Consequently, a catalytically effective coating remains, even under high dynamic loading. Detachment of these end regions from the honeycomb body is prevented, with the result that the catalyst carrier body has an increased service life with the best possible effectiveness with respect to pollutant reduction.

In accordance with another feature of the invention, the catalyst carrier body is used for a catalytic converter and the sleeve is displaceable with respect to the jacket tube during thermal expansion or elongation of the honeycomb body. In this way it is possible to compensate for the different thermal expansions or elongations of the jacket tube and the honeycomb body under thermal loading of the catalyst carrier body.

In accordance with a further feature of the invention, the sleeve extends up to at least the end surface of the honeycomb body and is connected to the end regions of the layers of sheet metal. The end regions of the layers of sheet metal are consequently fixed particularly well.

In accordance with an added feature of the invention, the sleeve protrudes beyond a rim of the jacket tube, and an edge of the sleeve is bent around radially outwardly in such a way that it bears in the form of a collar against the rim of the jacket tube. This has the effect of producing a type of stop which prevents the honeycomb body from penetrating into the jacket tube beyond a predeterminable depth of insertion when the honeycomb body is inserted and/or during the operation of the catalyst carrier body.

As mentioned above, the at least one microstructure of the sleeve causes the sleeve to have a smaller contact surface area with the jacket tube. This is particularly advantageous because, when there is thermal expansion of the honeycomb body, the sleeve is more easily displaceable with respect to the jacket tube due to the lower frictional forces, and thermal stresses between the jacket tube and the honeycomb body can be prevented particularly well. These microstructures extend at least partially over the axial length of the sleeve, although formation over the entire axial length is preferred.

In accordance with yet another feature of the invention, the microstructures are formed around the periphery. This means that the microstructures are disposed in the circumferential direction, in the axial longitudinal direction or helically on the sleeve. Such microstructures are known, for example, from European Patent EP 0 454 712 B1, corresponding to U.S. Pat. No. 5,157,010.

In accordance with yet a further feature of the invention, a plurality of microstructures cross one another, as is known, for example, from International Publication No. WO 96/09892.

In accordance with yet an added feature of the invention, the sleeve is constructed in such a way that the at least one microstructure only faces outward, that is toward the jacket tube. In this way, brazing of the sleeve onto the jacket tube is prevented, since only very small, in some cases only punctiform, contact surface areas provide the possibility for this to occur. In addition, the inner circumferential surface allows a good brazed connection with the honeycomb body, since consequently a linear contact surface area between the honeycomb body and the sleeve is at least partially provided.

In accordance with yet an additional feature of the invention, the honeycomb body has at least one sheet metal layer with two sheet metal layer ends, the at least one sheet metal layer comes to bear with at least one sheet metal layer end against the inner circumferential surface of the sleeve, and the inner circumferential surface is connected by technical joining to at least one sheet metal layer end in bearing contact. The inner circumferential surface of the sleeve is preferably connected by technical joining to all of the sheet metal layer ends in bearing contact.

In accordance with again another feature of the invention, the honeycomb body has at least one structured sheet metal layer with elevations, the at least one structured sheet metal layer comes to bear with its elevations against the inner circumferential surface of the sleeve, and the elevations in bearing contact are connected by technical joining to the inner circumferential surface of the sleeve.

In accordance with again a further feature of the invention, a connection between the sleeve and the honeycomb body has a greater strength than a possible production-related connection of the sleeve and the jacket tube. This increased strength ensures that stresses which occur due to different thermal expansions are reduced as a result of the fact that the connection of the sleeve and jacket tube is released first. A connection of the sleeve and the jacket tube may occur intentionally or unintentionally during the production of the catalyst carrier body, in particular by prefixing of the sleeve in the jacket tube or by unintentional spot-brazed connections.

In accordance with again an added feature of the invention, the connection by technical joining between the honeycomb body and jacket tube is a brazed connection. It is particularly advantageous if the honeycomb body is vacuum-brazed to the jacket tube at high temperature. This connection is distinguished by the fact that it withstands even extreme thermal and mechanical conditions, as can occur in the exhaust system of an internal combustion engine of a motor vehicle, in particular when a catalyst carrier body is installed near the engine.

A method of producing the catalyst carrier body with a honeycomb body, a jacket tube and a sleeve, includes initially forming the honeycomb body in the known way by laminating and/or winding layers of sheet metal, at least some of which are structured layers of sheet metal, so that the honeycomb body has channels through which an exhaust gas can flow. The sleeve is subsequently inserted into the jacket tube, with the sleeve coming to bear essentially against part of the inner wall surface of the jacket tube. In this case, it is expedient to place the sleeve in the jacket tube in such a way that, in the fitted state, it is near a region of one end surface of the honeycomb body. Subsequently, the inner wall surface of the jacket tube and at least a peripheral circumferential region of the inner circumferential surface of the sleeve arc brazed. After that, the honeycomb body is inserted into the jacket tube and the sleeve, with an end surface of the honeycomb body protruding axially beyond a rim of the jacket tube near the sleeve. A bonding agent is then applied to the protruding end surface and to an outer region near the protruding end surface of the honeycomb body. The axially protruding parts of the honeycomb body make it easier to apply a bonding agent. Subsequently, the honeycomb body is inserted completely into the metal tube and the sleeve. The honeycomb body is then brazed by applying brazing material, in particular brazing powder, to the end surface. It is particularly advantageous if, after this method step, there are grains of brazing material on an outer region near the end surface of the honeycomb body between the sleeve and honeycomb body. After that, the brazed connection can be formed between the honeycomb body and the jacket tube and between the honeycomb body and the sleeve.

The sleeve is vacuum-brazed at high temperature to the end regions of the layers of sheet metal of the honeycomb body.

The sleeve is adhesively bonded to the inner wall surface of the jacket tube before the honeycomb body is inserted. Adhesive used for this purpose evaporates at least partially during the formation of the brazed connection. In this way it is ensured that the sleeve can slide on the inner wall surface of the jacket tube due to the different thermal expansions of the honeycomb body and the jacket tube.

The edge of the sleeve is initially bent radially outward and the bent-around edge comes to bear against the rim of the jacket tube after the honeycomb body has been completely inserted into the jacket tube and into the sleeve. Particularly exact axial fixing of the honeycomb body in the jacket tube takes place in this way.

Other features which are considered as characteristic for the invention are set forth in the appended claims.

Although the invention is illustrated and described herein as embodied in a catalyst carrier body having a sleeve with microstructures allowing expansions, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
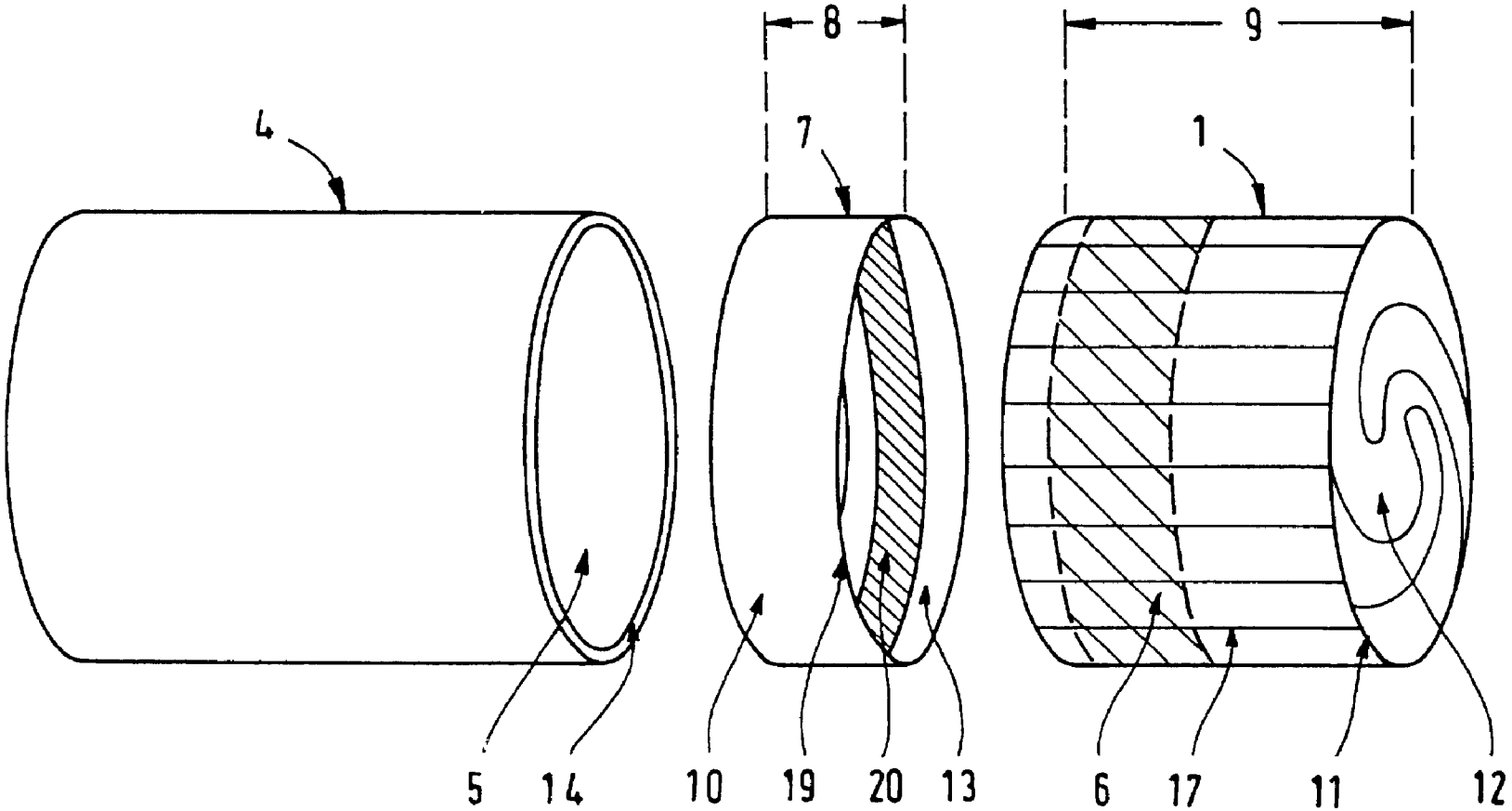
FIG. 1 is a diagrammatic, exploded, perspective view of a honeycomb body, sleeve and jacket tube of a catalyst carrier body according to the invention.

Referring now to the figures of the drawings in detail and first, particularly, to FIG. 1 thereof, there is seen a honeycomb body 1 with an end surface 12 and an axial length 9. It is seen that an outer region 11 of the honeycomb body 1 has an axial subregion 6 with which the honeycomb body 1 can be technically joined to a jacket tube 4. Furthermore, sheet metal layer ends 17 can also be seen on the outer region 11.

A sleeve 7 which is also shown has an axial length 8 that is less than the axial length or extent 9 of the honeycomb body 1. The sleeve 7 has an outer circumferential surface 10 and an inner circumferential surface 13 as well as an edge 19. The edge 19 is bent around to bear against the rim 14 like a collar. A circumferential region 20 serves for fixing the sleeve 7 on the honeycomb body 1 near the end surface 12 of the latter.

The jacket tube 4 has an inner wall surface 5 and an end-surface rim 14. In the joined state, the jacket tube 4 encloses the honeycomb body 1 with the sleeve 7.

Figure 2:
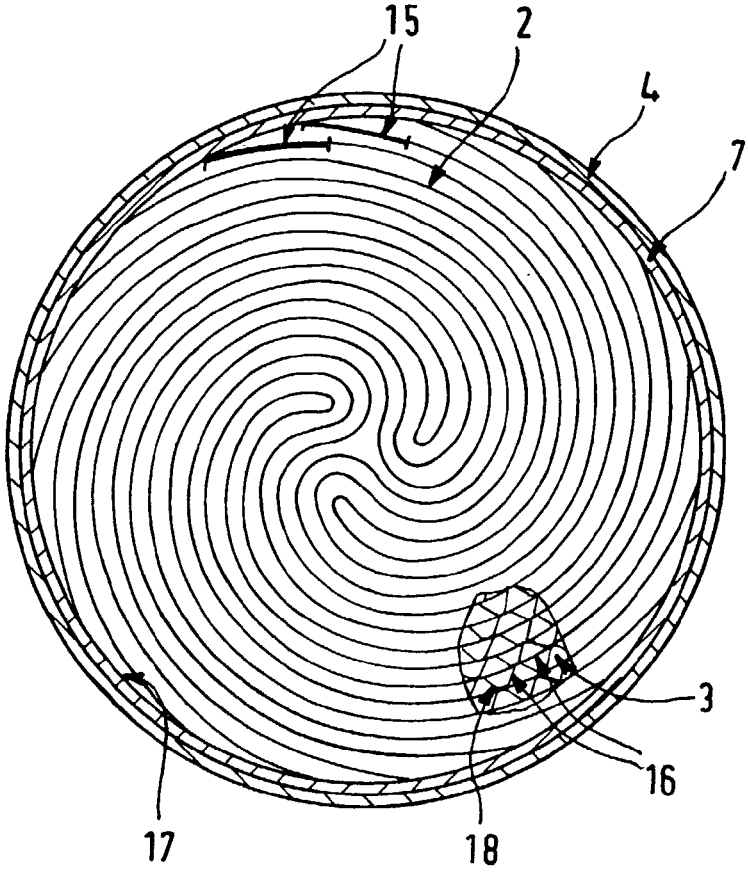
FIG. 2 is an end-elevational view of a joined embodiment of a catalyst carrier body according to the invention.

The production of the catalyst carrier body described above takes place by producing the honeycomb body 1 in a first step by laminating and/or winding layers 2 of sheet metal as are seen in FIG. 2. The sleeve 7 is inserted into the jacket tube 4, with the outer circumferential surface 10 coming to bear against the inner wall surface 5 of the jacket tube 4. The inner wall surface 5 of the jacket tube 4 and the peripheral circumferential region 20 of the sleeve 7 are brazed. Then, the honeycomb body 1 is inserted into the jacket tube 4 and the sleeve 7. As this occurs, the position of the sleeve 7 in the jacket tube 4 is to remain as unchanged as possible. The honeycomb body 1 partially protrudes axially beyond the rim 14 of the jacket tube 4. The protruding end surface 12 of the honeycomb body 1 and the outer region 11 near the end surface 12 are provided with an adhesive or bonding agent. The adhesive or bonding agent ensures that adequate brazing of the end surface 12 and of the sheet metal layer ends 17 near the end surface 12 takes place. The honeycomb body 1 is then completely inserted into the jacket tube 4 and the sleeve 7 by applying external force. It is particularly advantageous if the end surface 12 of the honeycomb body 1 terminates flush with the edge 19 of the sleeve 7. In a following method step, a technical joining connection is formed between the honeycomb body 1 and the jacket tube 4 as well as between the honeycomb body 1 and the sleeve 7. It is preferred for these connections to be performed in such a way that a high-temperature vacuum brazing takes place.

FIG. 2 shows an end-elevational view of a catalyst carrier body according to the invention, with a jacket tube 4, a sleeve 7 and a honeycomb body 1 produced from layers 2 of sheet metal. The layers 2 of sheet metal include at least some structured layers 2 of sheet metal and have been laminated and/or wound in such a way that the honeycomb body 1 is provided with channels 3 through which an exhaust gas can flow. The structured layers 2 of sheet metal are produced, for example, by sheet metal layers 16. Some of these sheet metal layers 16 have elevations 18 which, in the case of conventional honeycomb bodies, typically are wave crests. The layers 2 of sheet metal have radially outer end regions 15 which bear against the sleeve 7. In the illustrated embodiment, the sheet metal layer ends 17 of the sheet metal layers 16 bear against the sleeve 7. It is particularly advantageous if all of the sheet metal layer ends 17 are connected to the sleeve 7, after the high-temperature vacuum brazing operation.

A catalyst carrier body which is formed in this way can compensate for the different thermal expansions or elongations of the honeycomb body 1 and the jacket tube 4 under thermal loading. This is due to the fact that the end regions 15 at the end surface of the honeycomb body 1 are able to slide with the sleeve 7 on the inner wall surface 5 of the jacket tube 4. Due to the technical joining connection of the end regions 15 to the sleeve 7, flapping of the layers 2 of sheet metal is prevented, so that a catalyst carrier body which is particularly able to withstand loading is produced, especially for installation near the engine.

Figure 3:
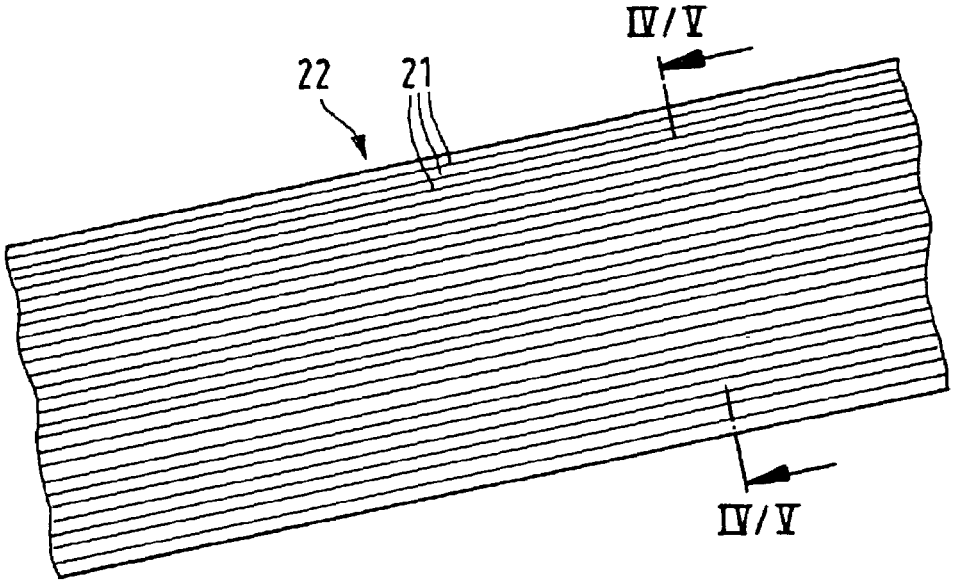
FIG. 3 is a fragmentary, plan view of a sheet metal layer of the sleeve with microstructures.

FIG. 3 shows a metal sleeve sheet 22 for producing the sleeve 7 with microstructures 21. After forming of the metal sleeve sheet 22 into a sleeve 7, any desired oriented direction of expansion of the microstructures 21 running parallel to one another is possible.

Figure 6:
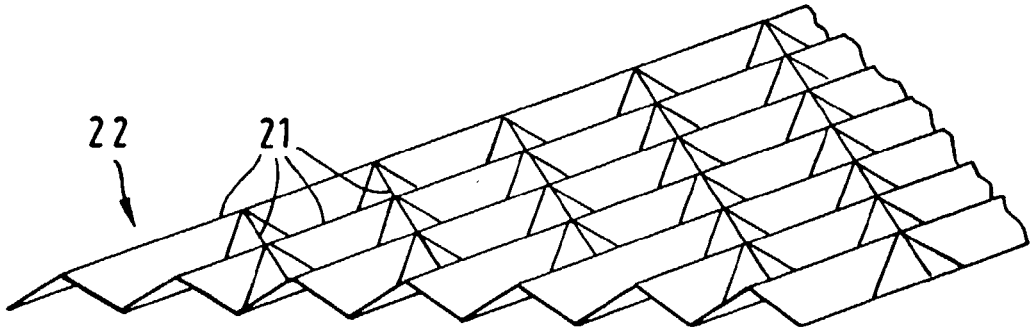
FIG. 6 is a fragmentary, perspective view of a sheet metal layer of the sleeve with microstructures crossing one another.
Figure 4:
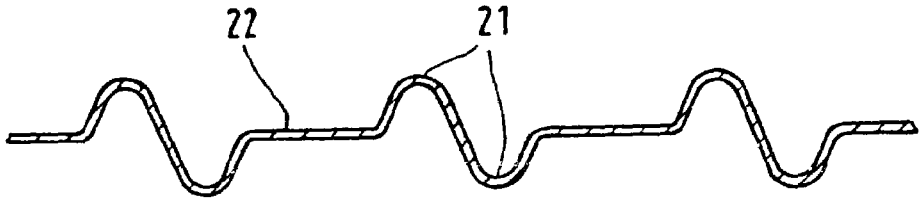
FIG. 4 is a fragmentary, sectional view of an exemplary embodiment of the sheet metal layer of the sleeve with microstructures, which is taken along a line IV—IV of FIG. 3, in the direction of the arrows.
Figure 5:
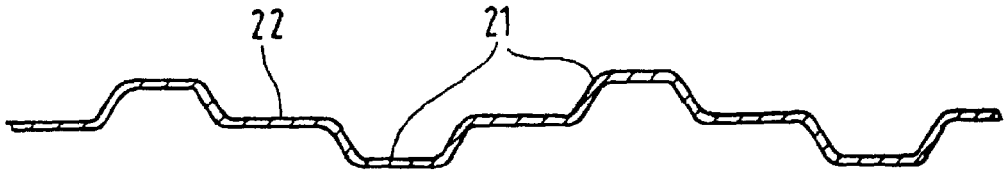
FIG. 5 is a view similar to FIG. 4 of a further exemplary embodiment of the sheet metal layer of the sleeve with microstructures, which is taken along a line V—V of FIG. 3, in the direction of the arrows.

FIGS. 4 and 5 are sectional views showing two exemplary embodiments of metal sleeve sheets 22 with differently formed microstructures 21. FIG. 6 is a perspective view of another metal sleeve sheet 22 with microstructures 21 crossing one another.

The preferred manner of producing the technical joining connection is by brazing. However, a sintering process or even welding may be used as well.

We claim:

1. A catalyst carrier body, comprising:

a honeycomb body having layers of sheet metal, an outer region, at least one axial subregion, an end surface and an axial extent, said layers of sheet metal having radially outward end regions, and at least some of said layers of sheet metal structured to form channels in said honeycomb body through which an exhaust gas can flow;

a jacket tube having an inner wall surface at least partially enclosing said honeycomb body, said jacket tube connected to said honeycomb body by technical joining only in said at least one axial subregion; and a sleeve having an axial length less than said axial extent of said honeycomb body, said sleeve having an outer circumferential surface coming to bear substantially against part of said inner wall surface of said jacket tube at a contact area, said sleeve disposed on said outer region of said honeycomb body near said end surface, said sleeve having an inner circumferential surface connected by technical joining to said end regions of said layers of sheet metal at said end surface for preventing flapping of said end regions, and said sleeve having at least one microstructure for reducing said contact area between said sleeve and said jacket tube.

2. The catalyst carrier body according to claim 1, wherein said sleeve is displaceable relative to said jacket tube during expansion of said honeycomb body.

3. The catalyst carrier body according to claim 1, wherein said sleeve extends at least to said end-surface of said honeycomb body.

4. The catalyst carrier body according to claim 1, wherein said jacket tube has a rim, said sleeve protrudes beyond said rim, and said sleeve has an edge bent around to bear against said rim as a collar.

5. The catalyst carrier body according to claim 1, wherein said sleeve has a periphery around which said at least one microstructure is formed.

6. The catalyst carrier body according to claim 1, wherein said at least one microstructure is a plurality of microstructures crossing one another.

7. The catalyst carrier body according to claim 1, wherein said at least one microstructure faces only radially outward toward said jacket tube.

8. The catalyst carrier body according to claim 1, wherein said layers of sheet metal include at least one sheet metal layer with two sheet metal layer ends, at least one of said sheet metal layer ends of said at least one sheet metal layer bearing against said inner circumferential surface of said sleeve, and said inner circumferential surface of said sleeve connected by technical joining to at least one of said sheet metal layer ends in bearing contact.

9. The catalyst carrier body according to claim 1, wherein said layers of sheet metal include at least one sheet metal layer with two sheet metal layer ends, at least one of said sheet metal layer ends of said at least one sheet metal layer, bearing against said inner circumferential surface of said sleeve, and said inner circumferential surface of said sleeve connected by technical joining to all of said sheet metal layer ends in bearing contact.

10. The catalyst carrier body according to claim 1, wherein said layers of sheet metal include at least one structured sheet metal layer with elevations, said elevations of said at least one sheet metal layer bear against said inner circumferential surface of said sleeve, and said inner circumferential surface of said sleeve connected by technical joining to said elevations in bearing contact.

11. The catalyst carrier body according to claim 1, wherein said sleeve and said honeycomb body have a connection therebetween with a greater strength than a production-related connection of said sleeve and said jacket tube.

12. The catalyst carrier body according to claim 1, wherein said honeycomb body is brazed to said jacket tube.

13. The catalyst carrier body according to claim 1, wherein said honeycomb body is vacuum-brazed to said jacket tube at high temperature.

14. The catalyst carrier body according to claim 1, wherein said sleeve has an edge, said inner circumferential surface of said sleeve has a peripheral circumferential region, and said radially outward end regions of said layers of sheet metal at said end surface are brazed to said sleeve near said edge and at least in said peripheral circumferential region.

15. The catalyst carrier body according to claim 1, wherein said sleeve has an edge, said inner circumferential surface of said sleeve has a peripheral circumferential region, and said radially outward end regions of said layers of sheet metal at said end surface are vacuum-brazed to said sleeve at high temperature near said edge and at least in said peripheral circumferential region.

* * * * *